US006981449B2

(12) United States Patent
Sadeck

(10) Patent No.: US 6,981,449 B2
(45) Date of Patent: Jan. 3, 2006

(54) PROJECTILE LAUNCH ASSEMBLY AND METHOD

(75) Inventor: James E. Sadeck, East Freetown, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 12 days.

(21) Appl. No.: 10/748,918

(22) Filed: Dec. 22, 2003

(65) Prior Publication Data

US 2005/0132629 A1 Jun. 23, 2005

(51) Int. Cl.
*F42B 10/00* (2006.01)

(52) U.S. Cl. ..... 102/485; 42/105

(58) Field of Classification Search ..... 42/105; 102/483–485

See application file for complete search history.

(56) References Cited

U.S. PATENT DOCUMENTS 3,243,909 A * 4/1966 Kotikov ..... 42/105
3,276,036 A * 10/1966 Cater et al. ..... 2/114
4,060,117 A * 11/1977 Chabot et al. ..... 411/147
4,505,179 A * 3/1985 Nelson et al. ..... 89/16
4,567,831 A * 2/1986 Gordon et al. ..... 102/485
4,793,259 A * 12/1988 Ambrosi et al. ..... 102/485
4,799,906 A 1/1989 Perkins, Jr.
5,099,747 A 3/1992 Smith
5,349,906 A 9/1994 Devaux et al.
5,448,937 A 9/1995 Buc et al.
5,574,245 A 11/1996 Buc et al.
5,811,713 A 9/1998 Gudgel
6,408,765 B1 * 6/2002 Tauber et al. ..... 102/499

* cited by examiner

*Primary Examiner*—M. Clement
(74) *Attorney, Agent, or Firm*—Vincent J. Ranucci

(57) ABSTRACT

A projectile launch assembly includes a launch tube having distal and proximal ends and an inwardly extending dimple structure therebetween, the proximal end being configured to receive a firearm muzzle, a receiver disposed on the distal end of the launch tube and having connector structure at a distal end thereof for connection to a projectile, an energy absorbing plug disposed in the launch tube and having a proximal end portion adjacent the dimple and a body portion extending distally, and an energy transfer piston disposed in the launch tube and having a proximal end configured complementarily to the plug and having a distal end configured complementarily to a proximal end of the receiver. A bullet leaving the firearm muzzle is absorbed by the plug which is thereby moved with the piston distally in the tube, the piston engaging the receiver to propel the launch assembly and projectile from the firearm muzzle.

25 Claims, 4 Drawing Sheets

PROJECTILE LAUNCH ASSEMBLY AND METHOD

STATEMENT OF GOVERNMENT INTEREST

The invention described herein may be manufactured and used by the U.S. Government for Governmental purposes without the payment of any royalty thereon.

BACKGROUND OF THE INVENTION

1. Field of the Invention

The invention relates to the launching of small projectiles, and more specifically is directed to an assembly and method for launching such projectiles from firearms, such as rifles.

2. Description of the Prior Art

Launchers which facilitate the firing of a projectile such as, for example, a rifle grenade, from a rifle are generally known and in use.

However, in non-combat situations, as in training, or the like, the launch assemblies, which may be readily recoverable, are not reusable. That is, even on a practice range the launch assemblies are adapted only for one-time use.

It will be apparent that economies could be realized if launchers which are readily recoverable could be used multiple times before discarding.

SUMMARY OF THE INVENTION

An object of the invention is, therefore, to provide a projectile launch assembly which is suitable for providing a projectile launch capability for a rifle, and which can be used, for the most part, time and time again.

A further object of the invention is to provide a method for launching a projectile from a firearm, including providing a launch device capable of multiple reuses.

With the above and other objects in view, a feature of the present invention is the provision of a projectile launch assembly including a launch tube having distal and proximal ends and an inwardly extending dimple structure therebetween, the proximal end being adapted to receive a muzzle of a firearm. A receiver is disposed on the distal end of the launch tube, the receiver having connector structure at a distal end thereof for connection to a projectile. An energy absorbing plug is disposed in the launch tube and is provided with a proximal end portion adjacent the dimple and is provided with a body portion extending distally. An energy transfer piston is disposed in the launch tube and is provided with a proximal end configured complementarily to the plug and with a distal end configured complementarily to a proximal end of the receiver. A bullet leaving the firearm muzzle is absorbed by the plug which is thereby moved with the piston distally in the tube. The piston engages the receiver to propel the assembly and the projectile from the firearm muzzle.

In accordance with a further feature of the invention, there is provided a method for launching a projectile from a firearm, the method comprising the steps of providing a projectile launch assembly comprising a launch tube having distal and proximal ends and an inwardly extending dimple therebetween, a receiver disposed on the distal end of the launch tube, the receiver having connector structure at a distal end thereof for connection to a projectile, an energy absorbing plug having a proximal end portion adjacent the dimple, a body portion extending distally, and an energy transfer piston adjacent the plug and having a proximal end configured complementarily to the plug and having a distal end configured complementarily to a proximal end of the receiver; manipulating the receiver connector structure to connect a selected projectile to the receiver; sliding the launch tube onto a muzzle portion of a firearm until a distal end of the muzzle portion engages the dimple; and firing the firearm. A bullet leaving the firearm muzzle is absorbed by the plug which is thereby moved with the piston distally in the tube. The piston engages the receiver to propel the assembly and the projectile from the firearm muzzle.

The above and other features of the invention, including various novel details of construction and combinations of parts and steps, will now be more particularly described with reference to the accompanying drawings and pointed out in the claims. It will be understood that the particular assembly and method embodying the invention are shown and described by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
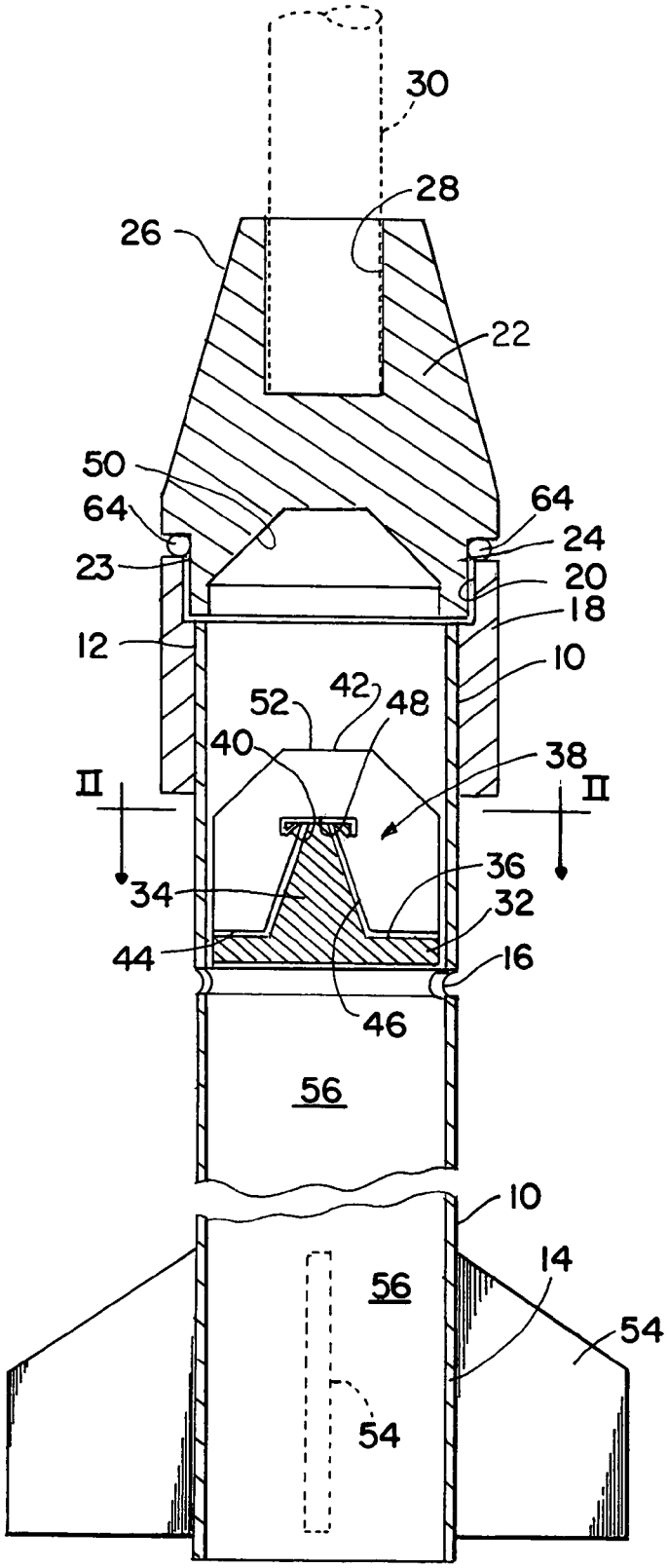
FIG. 1 is an interrupted center line sectional view of one form of projectile launch assembly illustrative of an embodiment of the invention for low velocity ammunition.
Figure 2:
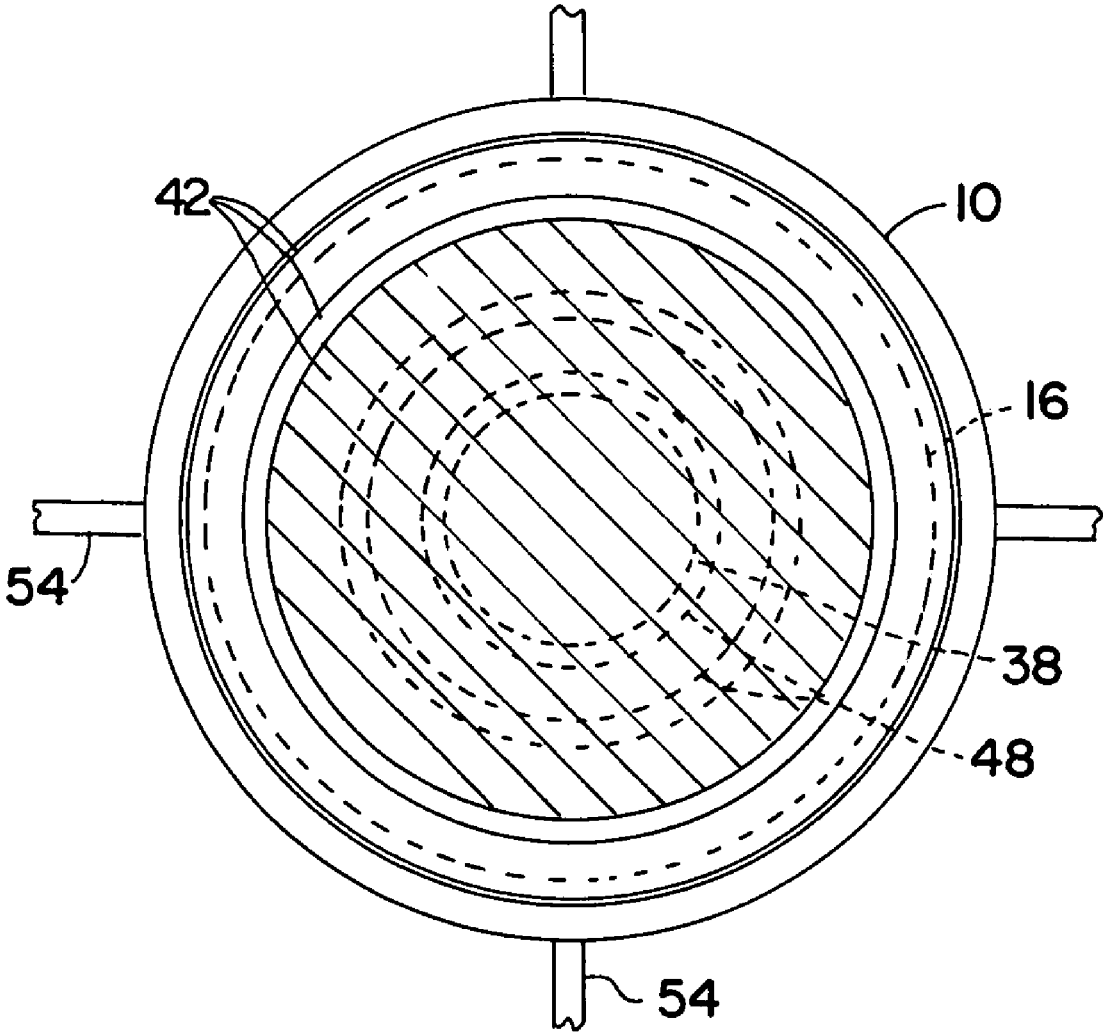
FIG. 2 is a sectional view taken along line II—II of the whole assembly depicted in section in FIG. 1.

Referring to FIGS. 1 and 2, it will be seen that an illustrative embodiment of projectile launch assembly includes a cylindrically-shaped elongated launch tube 10 having a distal end 12 and a proximal end 14. An inwardly extending dimple 16 is disposed between the launch tube distal and proximal ends 12, 14. The dimple 16 may be a continuous single annular dimple, as illustrated, or a plurality of dimples arranged in annular fashion.

A collar 18 is mounted, as by threads or press-fit, on the distal end 12 of the launch tube 10. The collar 18 is provided with connector structure 20, such as screw threads.

The assembly further includes a receiver 22 which is provided at its proximal end 23 with connector structure 24, such as screw threads, for connecting engagement with the collar connector structure 20, to affix the receiver 22 to the launch tube distal end 12. The receiver 22, at a distal end 26 thereof, is provided with further connector structure 28, such as a threaded bore, for connection to a stem 30 of a projectile. One such projectile for which the launch assembly described herein is well suited is a grappling hook generally of the type disclosed in U.S. Pat. No. 6,079,761, issued Jun. 27, 2000, in the name of James E. Sedeck, and incorporated herein by reference.

Mounted in the launch tube 10 is a circular plug 32 configured to fit snugly in the launch tube 10 abutting the dimple 16. The plug 32 includes a frusto-conical portion 34 extending from a planar portion 36. At a distal end 38 of the frusto-conical portion 34 there is disposed an end disc portion 40, or other such protuberance.

Connected to the plug 32 is a piston 42 provided with a proximal end 44 adjacent the planar portion 36 of the frusto-conical portion 34 and having a recess 46 therein in which is disposed the frusto-conical portion 34 of the plug 32. The piston 42 is further provided with a relief cut 48 which receives the end disc portion 40 of the plug 32. The relief cut 48, in cooperation with the end disc portion 40, serves to interconnect the piston 42 and the plug 32, both of which are slidably movable in the launch tube 10.

The receiver proximal end 23 is provided with a recess 50 shaped complementarily to a distal end 52 of the piston 42.

The proximal end 14 of the launch tube 10 may be provided with stabilizing fins 54.

Figure 3:
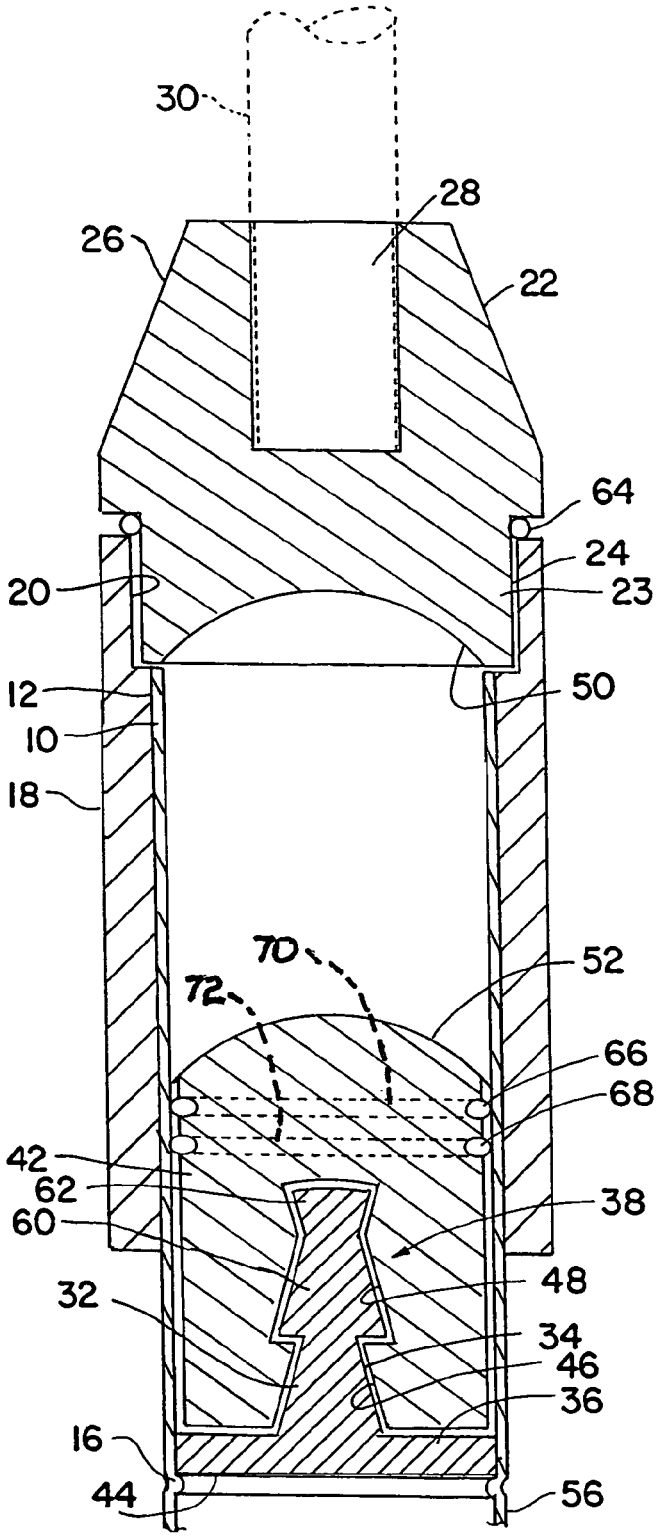
FIG. 3 is similar to FIG. 1 and is illustrative of an alternative embodiment of launch assembly for medium velocity ammunition.

Referring to FIG. 3, it will be seen that in an alternative embodiment, the plug 32 includes an end portion 38 which includes opposed frusto-conical shaped portions 60, 62 received in a complementarily shaped relief cut 48.

A sealing ring 64 seals a joint between the receiver 22 and the collar 18, preventing leakage of air from inside the launch tube 10 during movement of the piston 42. Similarly, sealing rings 66 and 68 are seated in annular grooves 70, 72 in the piston 42 to prevent leakage of air between the piston and the launch tube 10.

In this embodiment, the receiver recess 50 is of a curved configuration and the piston distal end 52 is complementarily shaped, providing for an even distribution of compressive force over the two surfaces 50, 52 and dissipation of heat in operation of the assembly.

In operation, the proximal end 14 of the launch tube 10 receives in a cavity 56 the muzzle and flash suppresser of a rifle (not shown) such that the flash suppresser is essentially flush with the plug planar portion 36. The butt of the rifle is placed against the ground or other support and inclined at a selected launch angle. The rifle is fired in the usual manner.

A bullet leaving the rifle impacts the plug 32 which is of a selected material such as a polymer, lead, soft aluminum, copper, brass, and composites or alloys thereof, or other material adapted to receive and appreciably slow the bullet. The bullet embedding in the plug 32 drives the plug 32 and the piston 42, which preferably is of hardened or cold-rolled steel, distally, such that the piston distal end 52 impacts the receiver 22 in the receiver recess 50 and compresses air in the recess 50, such that the bullet is dynamically decelerated. The compressed air, and expanding powder explosion gases from the rifle cartridge, and the violent impact of the piston on the receiver proximal end recess 50, serve to lift the launch assembly and the projectile 30 off of the rifle.

If the launch assembly is recovered, the receiver 22 can be unscrewed from the collar 18 and the piston 42 and plug 32 removed. The plug 32 can then be withdrawn from the piston 42, the relative softness of the plug permitting withdrawal of the plug end disc portion 40 from the relief cut 48 in the steel piston. A new plug 32 is then inserted in the piston recess 46. The piston 42 and new plug 32 are then slid down the launch tube 10 until the plug planar portion 32 is disposed adjacent the dimple 16. The receiver 22 is threaded back onto the collar 18 to place the launch assembly in condition to receive another projectile for launch.

Figure 4:
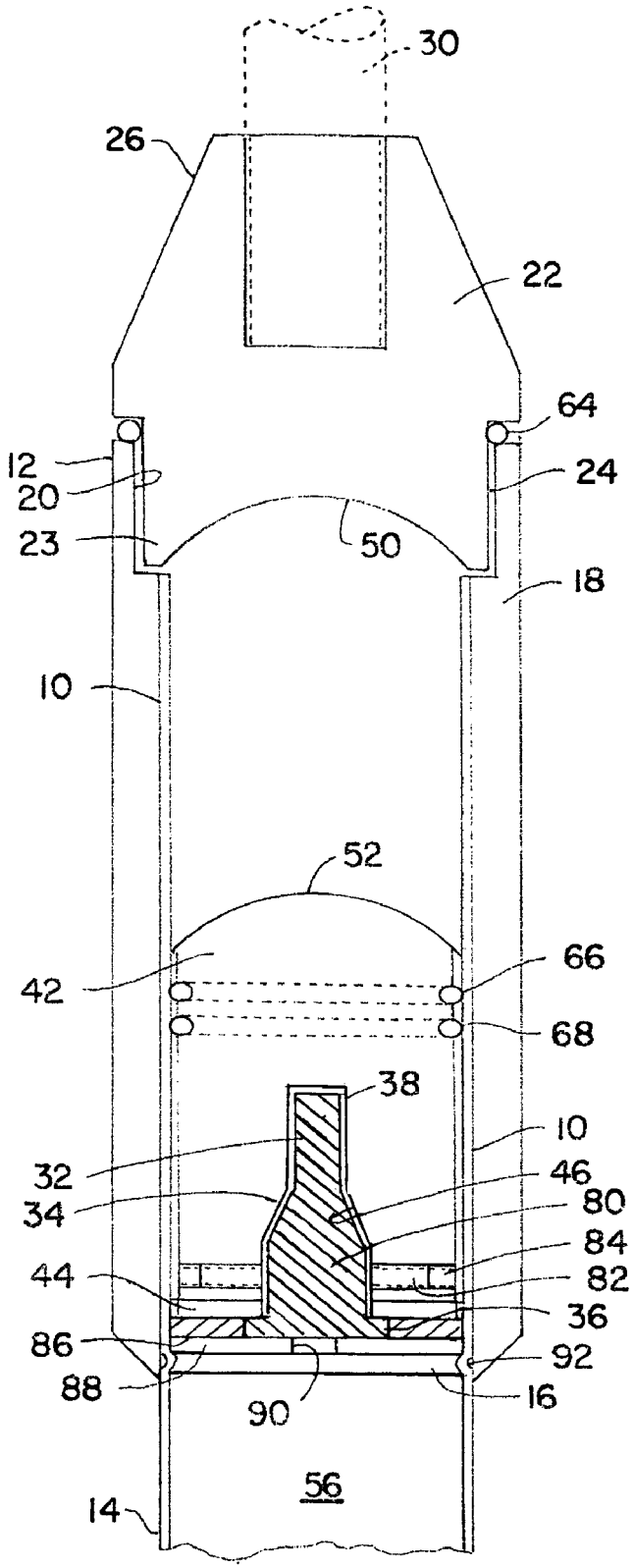
FIG. 4 is similar to FIGS. 1 and 3 and is illustrative of a further alternative embodiment of launch assembly for high velocity ammunition.

Referring to FIG. 4, it will be seen that in a further alternative embodiment, the plug 32 includes an end portion 38 which includes a frusto-conical portion 34 which, in turn, projects distally from a cylindrical portion 80 provided with a planar proximal end portion 36.

The plug 32 is of a high-density metallic, polymeric or cellulose material and in this embodiment is held in the piston 42 by screws 82 disposed in bores 84, the screws 82 projecting radially inwardly and engaging the plug cylindrical portion 80 to interconnect the plug 32 and the piston 42. A circular rubber or polymer washer 86 is held on the proximal end 44 of the piston 42 by the plug planar portion 36.

A circular bulkhead 88 is slightly oversized diameter-wise and is press-fitted into the launch tube 10 proximate the dimple structure 16. The bulkhead 88 is provided with a central aperture 90 which is slightly larger than the caliber of bullet fired from the rifle being used for launch.

As shown in FIG. 4, the collar 18 may be sufficiently elongated to extend proximally on the launch tube 10 to slightly beyond the dimple structure 16. The collar 18 may be provided with dimple structure 92 complementary to, and engageable with, launch tube dimple structure 16.

Upon firing of the rifle, the bullet (not shown) passes through the aperture 90 and embeds in the plug 32, and moves the plug 32 and the piston 42 distally in the launch tube 10. The washer 86 moves with the plug 32 and piston 42. The distal movement of the piston 42 compresses air between the piston and the receiver 22 and dynamically decelerates the bullet movement. Gas from the bullet powder charge enters the growing volume between the bulkhead 88, which remains stationary, and the washer 86, which moves distally with the plug 32. The gas expansion in the space between the bulkhead 88 and the washer 86 exerts pressure on the washer, creating an improved seal between the washer and the interior sidewall of the launch tube 10. The aforesaid space develops into a safety chamber which traps unburned powder particles and debris from the plug and the bullet.

Upon retrieval of the used launch assembly, the receiver 22 may be unscrewed from the collar 18 and the piston 42, plug 32 and washer 86 removed from the launch tube 10. The plug 32 and washer 86 are removed from the piston 42 by loosing the screws 82. A new plug 32 and washer 86 are connected to the piston 42 and the piston, plug, and washer assembly is moved through the launch tube 10 to the position shown in FIG. 4. The receiver 22 is screwed onto the launch tube distal end 12 to complete the reassembly. The launch assembly is then in condition for re-use.

There is thus provided projectile launch assemblies suitable for providing a projectile launch capability for a rifle and which can be used multiple times with replacement of only a portion thereof, thereby realizing significant economies. There is further provided a method for launching a projectile from a rifle, including use of a launch device which is for the most part reusable.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A projectile launch assembly comprising:

a launch tube having distal and proximal ends and an inwardly extending structure therebetween, the proximal end being adapted to receive a muzzle of a firearm;

a receiver disposed on the distal end of the launch tube, said receiver having connector structure at a distal end thereof for connection to a projectile;

an energy absorbing plug disposed in said launch tube and having a proximal end portion adjacent the dimple; and an energy transfer piston disposed in said launch tube and adjacent said plug and having a proximal end configured complementarily to said plug and having a distal end configured complementarily to a proximal end of said receiver;

wherein a bullet fired from the firearm muzzle is absorbed by said plug which is thereby moved with said piston distally in said tube;

wherein said piston engages said receiver to propel the assembly and the projectile from the firearm muzzle; and wherein the proximal end of said receiver is provided with a recess therein and the distal end of said piston is configured complementarily to the recess.

2. The assembly in accordance with claim 1 wherein the receiver proximal and recess is of a frusto-conical configuration.

3. The assembly in accordance with claim 1 wherein said launch tube is a cylindrically shaped elongated tube.

4. The assembly in accordance with claim 3 wherein the dimple structure extends radially inwardly from a wall of said launch tube, to form an annularly-shaped dimple structure arrangement.

5. The assembly in accordance with claim 1 and further comprising a collar mounted on the distal end of the launch tube, said collar being connectable to said receiver to thereby fix said receiver on said launch tube.

6. The assembly in accordance with claim 5 wherein said receiver is releasably fixed to said collar.

7. The assembly in accordance with claim 6 wherein said receiver is threadedly fixed to said collar.

8. The assembly in accordance with claim 2 wherein the plug body portion comprises a frusto-conically shaped portion extending toward said receiver from the plug proximal end portion.

9. The assembly in accordance with claim 8 wherein a distal end of the plug body portion is provided with an enlarged end portion extending outwardly beyond a small end of the frusto-conically shaped plug body portion, and said piston is provided with a cavity in which the plug enlarged end portion is disposed, such that the plug enlarged end portion and the piston cavity effect interconnection of said plug and said piston.

10. The assembly in accordance with claim 7 wherein said receiver is threadedly removable from said collar to open the distal end of said launch tube, said piston and said plug are removable from the launch tube open distal end, and said piston is removable from said plug.

11. The assembly in accordance with claim 9 wherein said plug is of at least one material selected from a group of materials consisting of a polymer, lead, aluminum, copper, brass, and composites and alloys thereof, and said piston is of steel, and said plug is removable from said piston and replaceable by a second plug of the same configuration.

12. The assembly in accordance with claim 1 wherein said receiver connector structure comprises a threaded axial recess in the distal end of said receiver.

13. The assembly in accordance with claim 12 wherein said threaded axial recess is adapted to receive a threaded shaft of a grappling hook.

14. The assembly in accordance with claim 1 wherein the proximal end of said launch tube is adapted to receive a muzzle comprising a barrel and a flash suppresser.

15. The assembly in accordance with claim 1 and further comprising stabilization fins fixed to said launch tube and extending outwardly therefrom.

16. The assembly in accordance with claim 1 wherein the receiver proximal end recess is of a curved configuration.

17. The assembly in accordance with claim 7 and further comprising a sealing ring disposed between opposed edges of said collar and said receiver.

18. The assembly in accordance with claim 17 and further comprising at least one sealing ring mounted in an annular groove in said piston and engaged with an inside surface of said launch tube.

19. The assembly in accordance with claim 1 wherein said energy absorbing plug is fixed to said energy transfer piston by releasable screws.

20. The assembly in accordance with claim 1 and further comprising a bulkhead fixed in said launch tube proximate the dimple structure, said launch tube being provided with a central aperture adjacent the proximal end of said plug.

21. The assembly in accordance with claim 20 and further comprising a washer fixed to said plug and moveable therewith to create an expanding chamber between said washer and said bulkhead upon operation of the assembly.

22. A method for launching a projectile, the method comprising the steps of:

providing a projectile launch assembly comprising:

a launch tube having distal and proximal ends and an inwardly extending dimple therebetween;

a receiver disposed on the distal end of the launch tube, the receiver having connector structure at a distal end thereof for connection to a projectile;

an energy absorbing plug having a proximal end portion adjacent the dimple and a body portion extending distally; and an energy transfer piston adjacent the plug and having a proximal end configured complementarily to the plug and having a distal end configured complementarily to a proximal end of the receiver;

manipulating the receiver connector structure to connect a selected projectile to the receiver;

sliding the launch tube onto a muzzle portion of a firearm until a distal end of the muzzle portion engages the dimple; and firing the firearm;

wherein a bullet leaving the firearm muzzle is absorbed by the plug which is thereby moved with the piston distally in the tube;

wherein the piston engages the receiver to propel the launch assembly and the projectile from the firearm muzzle; and wherein the receiver connector structure comprises a threaded axial recess in the distal end of the receiver; and the step of connecting the projectile to the receiver comprises threadedly engaging a threaded shaft of the selected projectile with the threaded axial recess of the receiver.

23. The method in accordance with claim 22 wherein the selected projectile comprises a grappling hook having the threaded shaft.

24. The method in accordance with claim 22 wherein the step of sliding the launch tube onto a muzzle portion of a firearm comprises sliding the launch tube onto a barrel and flash suppressor of a rifle until the dimple engages the flash suppressor.

25. The method in accordance with claim 22 wherein the launch assembly further comprises a collar mounted on the distal end of the launch tube, and the method for launching a projectile further comprises the step of connecting the collar to the receiver whereby to fix the receiver on the launch tube.

* * * * *